United States Patent [19]

Gerdes

[11] 4,259,941

[45] Apr. 7, 1981

[54] FIREPLACE CONSTRUCTION FOR MOBILE HOMES

[75] Inventor: Heinrich D. Gerdes, Topeka, Kans.

[73] Assignee: Sadie M. Northwood, Kansas City, Mo.

[21] Appl. No.: 874,138

[22] Filed: Feb. 1, 1978

[51] Int. Cl.[3] ..... F24B 1/18

[52] U.S. Cl. ..... 126/120; 126/130; 126/137

[58] Field of Search ..... 126/120, 121, 130, 139, 126/140, 164; 237/51

[56] References Cited

U.S. PATENT DOCUMENTS

| | | | |
|---|---|---|---|
| 2,362,526 | 11/1944 | Austin | 126/121 |
| 2,393,812 | 1/1946 | Robinson | 126/120 |
| 2,409,731 | 10/1946 | Bolinger | 126/120 |
| 3,094,980 | 6/1963 | Inabnit | 126/121 |
| 3,180,332 | 4/1965 | Grushkin | 126/121 |
| 3,190,281 | 6/1965 | Northwood | 126/120 |
| 3,241,546 | 3/1966 | Northwood | 126/120 |
| 3,269,383 | 8/1966 | Maasberg | 126/164 |
| 3,802,415 | 4/1974 | Richard | 126/120 |
| 3,926,174 | 12/1975 | Bell | 126/121 |
| 3,952,721 | 4/1976 | Patterson | 126/120 X |
| 3,970,067 | 7/1976 | Vaughn | 126/120 |
| 4,013,059 | 3/1977 | Andrews | 126/120 |
| 4,068,649 | 1/1978 | Johnson | 126/120 |
| 4,095,581 | 6/1978 | Billmeyer et al. | 126/120 X |

*Primary Examiner*—Samuel Scott
*Assistant Examiner*—Randall L. Green
*Attorney, Agent, or Firm*—Fishburn, Gold & Litman

[57] ABSTRACT

A prefabricated fireplace construction for mobile homes comprises a firebox having an entranceway to a room, and an upstanding flue connected with the firebox for exhausting combustion gas to the outside atmosphere. A fluid duct has one end connected with the firebox, and the other end communicates with the outside atmosphere, whereby outside air is drawn by thermal siphoning through the duct into the firebox for supporting combustion therein, and substantially no inside air is drawn from the room by the flue.

4 Claims, 5 Drawing Figures

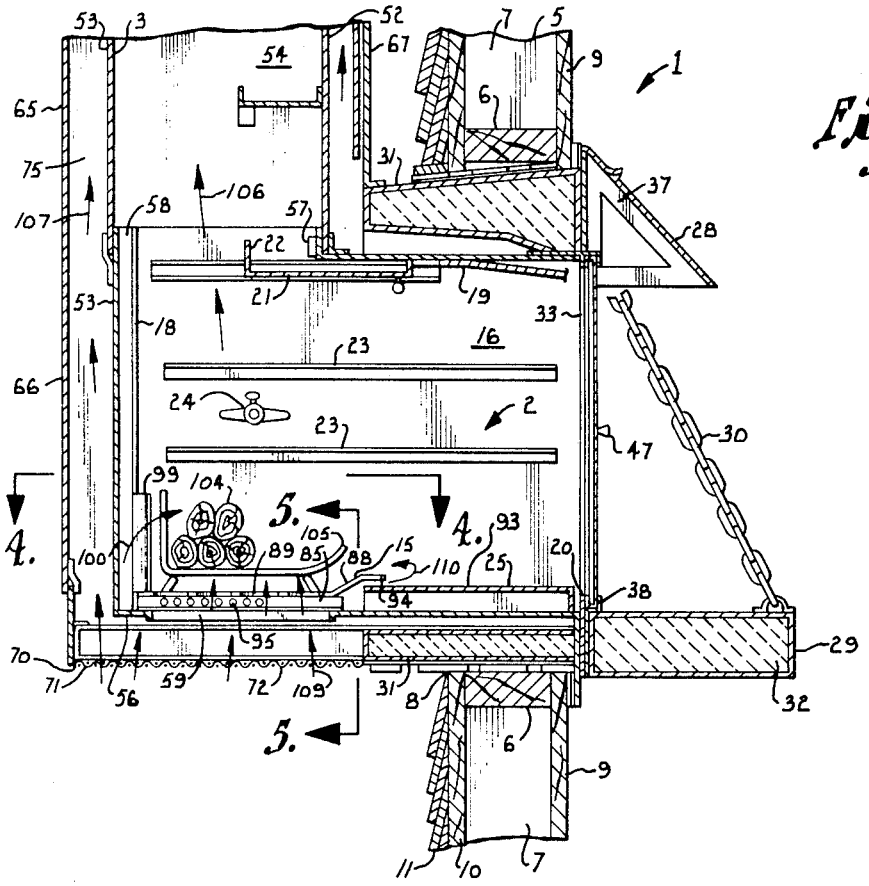
Fig. 2.
Fig. 3.
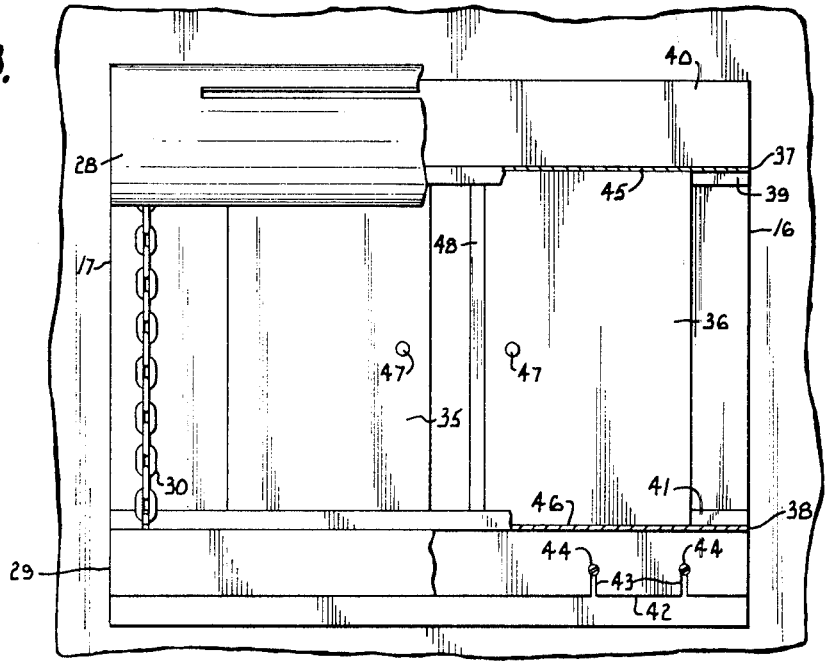

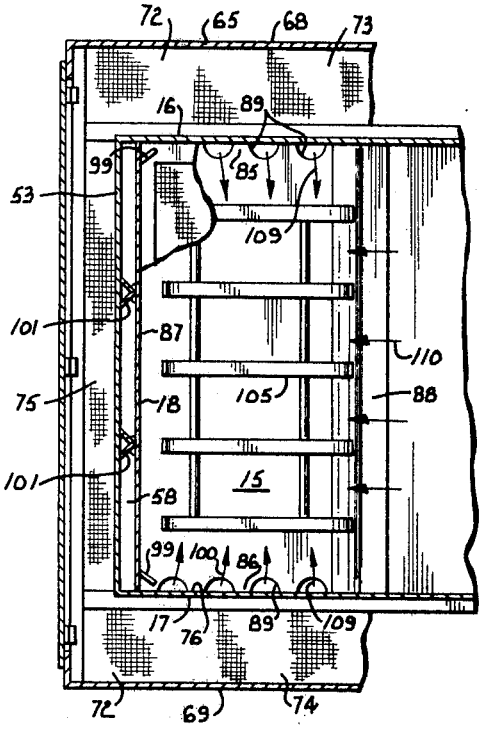
Fig. 4.
Fig. 5.
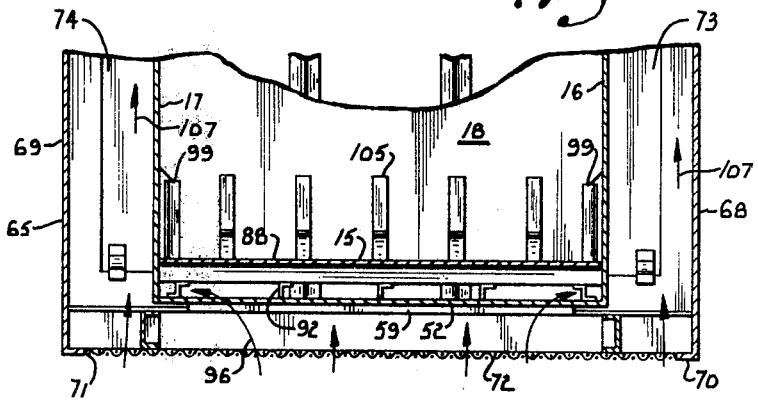

FIREPLACE CONSTRUCTION FOR MOBILE HOMES

BACKGROUND OF THE INVENTION

This invention relates to fireplace structures, and in particular to a prefabricated fireplace construction for mobile homes.

Prefabricated fireplace units such as those disclosed in U.S. Pat. Nos. 3,190,281 and 3,241,546 are particularly adapted for mounting in existing building walls. As with conventional brick fireplaces, when such units have a fire burning therein, air is drawn from the room and exhausted up through the flue into the outside atmosphere, thereby creating an air current in the room. This air current action creates a slight vacuum in the room or building in which the fireplace unit is located, and outside air therefor enters the room to equalize the pressure differential between the inside and outside of the room. Although this flow of outside air into the room in conventional fireplaces often creates a cool and rather uncomfortable draft, and further constitutes a source of inefficient energy usage, in conventionally constructed buildings this phenomenon does not result in any substantial safety hazard, inasmuch as the volume of air in the building is usually very large, and the outside air may freely enter the room about windows, doors, and other similar crevices and passageways.

Mobile homes have become increasingly popular for both residential and business purposes. To achieve thermal efficiency and yet maintain a relatively low weight, and compact size and design, mobile homes are typically constructed in a relatively air-tight fashion. Because of their compact design, and air-tight construction, it has heretofore been impracticable to install a fireplace unit in a mobile home in view of several substantial safety hazards. Governmental and independent inspection agencies for consumer products, such as H.U.D. and Underwriters Laboratories, have been unwilling to approve such fireplace units for mobile homes installation, unless it could be demonstrated that the unit would not draw any appreciable amount of air from inside the mobile home, and is otherwise safe in operation.

The principle objects of the present invention are: to provide a prefabricated fieplace construction for mobile homes having a fluid duct for drawing air from the outside atmosphere into a firebox portion thereof for supporting combustion therein whereby substantially no inside air is drawn from the room; to provide such a fireplace construction which is lightweight and may be located in contact with combustible supporting building materials without fire danger; to provide such a fireplace construction wherein outside air is drawn into the firebox for supporting combustion by thermal siphoning; to provide such a fireplace construction wherein the outside air is directed into the firebox in a continuous uniform fashion for complete and even burning of the fuel; to provide such a fireplace construction including closures for the firebox opening whereby outside air is prevented from entering the room when the unit is not in use; and to provide such a fireplace construction which is efficient in use, capable of a long operating life, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of this specification and include exemplary embodiments of the present invention and illustrate various objects and features thereof.

FIG. 2 is a fragmentary, vertical cross-sectional view of the fireplace unit shown installed in a building wall.

FIG. 3 is a fragmentary front elevational view of the fireplace unit, with portions thereof broken away to reveal internal construction.

FIG. 4 is a fragmentary horizontal cross-sectional view of the fireplace unit taken along line 4—4, FIG. 2.

FIG. 5 is fragmentary vertical cross-sectional view of the fireplace unit taken along FIG. 5—5, FIG. 2.

Figure 1:
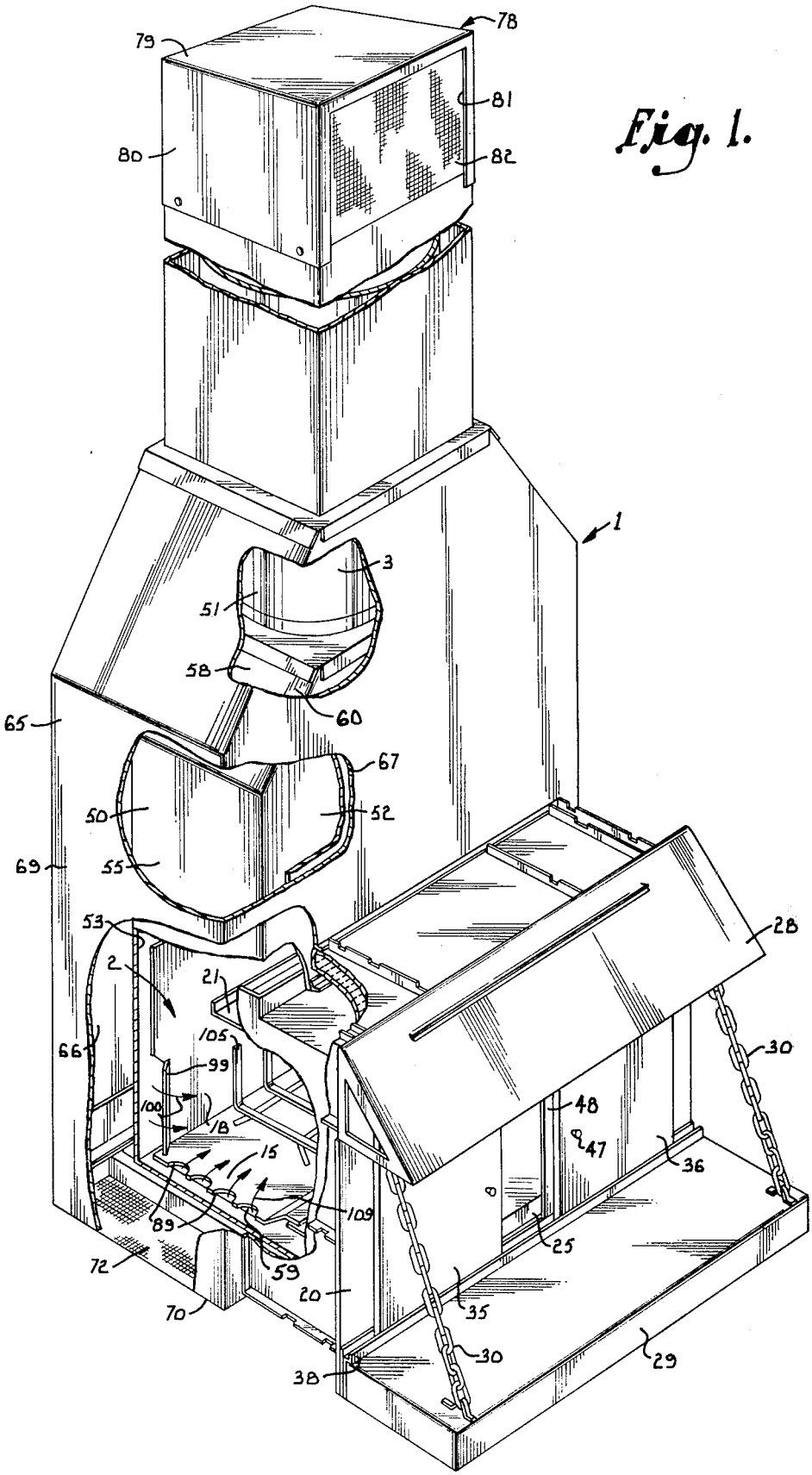
FIG. 1 is a perspective view of a prefabricated fireplace construction and unit embodying the present invention, having portions thereof broken away to particularly show a firebox portion of the unit.

Referring more in details to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

For purposes of description herein, the terms "upper, lower, right, left, rear, front, vertical, horizontal" and the like, shall relate to the invention as oriented in FIGS. 1 and 3, however, it is to be understood that the invention may assume various alternative orientations, and that the above references terms are not to be interpreted as limiting, except where expressly specified to the contrary.

The reference numeral 1 generally designates a prefabricated fireplace construction or unit for mobile homes embodying the present invention and comprising a firebox 2 having an entranceway into a room, and an upstanding flue 3 connected with the firebox for exhausting combustion gases to the outside atmosphere. The basic design of the fireplace unit 1 is similar to the fireplace construction disclosed in the U.S. Pat. No. 3,190,281, and as best illustrated in FIG. 2, is mounted on and supported by a building wall 5 by conventional flammable structural member such as wooden boxing studs 6 abutting against wall studs 7 to form an entranceway or opening 8 through the wall. It is to be understood that the opening 8 may take the form of a common, double hung window opening (not shown) and the building wall 5 may be an outside or inside wall without departing from the scope of this invention. The wall 5 has a finished interior surface 9 and an exterior surface 10, illustrated herein as having exterior wooden shingles 11.

The firebox 2 comprises a bottom panel 15, opposing side panels 16 and 17, a rear panel 18, an upper panel 19 and an apertured front panel 20 which are rigidly interconnected and form a structure in which the burning fuel is retained. The upper plate 19 includes a slidably mounted damper plate 21 having a upwardly turned end edge 22 which forms with the firebox rear panel 18 an aperture through which flue gases are exhausted from the firebox into the flue 3. In the illustrated example, each of the firebox side panels 16 and 17 is provided with a pair of brackets 23 which extend horizontally thereacross, and are fixedly attached thereto for receiving and supporting food retaining racks (not shown) thereon. A rotisserie device 24 extends between the firebox side panels 16 and 17 may be used for cooking foods thereon. An inner hearth 25 is attached to the base of the fireplace unit forward of and adjacent to the bottom panel 15 for purposes to be described hereinafter.

The firebox 2 extends slightly forwardly past the building wall interior surface 9, and is provided with decorative finishing members consisting of a hood 28, a hearth 29 and hearth supporting chains 30. In this example, an insulated mounting mechanism 31 surrounds that portion of the firebox positioned adjacent to the flammable framing members 6 and 7 and keeps the latter cool during operation of the fireplace unit. The interior portion 32 of the hearth 29 is similarly provided with a suitable heat insulative material. The interior edge of the front plate 20 forms an opening 33 which communicates the firebox with the room and allows heat to radiate therein.

Means are provided for closing and sealing the interior firebox opening 33, such that outside air is prevented from entering the room of the mobile home when the fireplace unit is not in use. In the illustrated example, a pair of doors 35 and 36 are slidably mounted adjacent the exterior surface of the firebox front plate 20 by upper and lower channel-shaped brackets 37 and 38 respectively. The lower bracket 38 includes a U-shaped track portion 39, and a depending flange portion 40 which is positioned between the firebox front plate 20 and the rearward wall of the hearth 29. The upper bracket 37 includes a similar U-shaped track portion 41, and a flange 42 which is positioned between the firebox upper plate 19 and the lower surface of the insulated mounting mechanism 31. The upper and lower end edges 45 and 46 of each of the doors are slidably received and mounted in the respective bracket members 37 and 38, and are adapted to slidingly translate therein. Each door includes a centrally located grip or knob 47 attached thereto to facilitate grasping by the user. The illustrated right hand door 36 includes a seal plate 48 which is connected along the inside edge thereof and overlaps the back of the inside edge of the door 35 to form a secure seal between the doors.

The flue 3 comprises a base portion 50 having a substantially rectangularly horizontal cross-sectional shape, and a cylindrically shaped upper portion 51 connected therewith. The flue lower portion 50 includes a front panel 52, a rear panel 53, opposing side panels 54 and 55, and a bottom panel 56 all of which are fixedly interconnected. The lower edge of the flue front panel 52 is connected with the rearward portion 57 of the firebox upper panel 19. The rear panel 53 of the flue is positioned rearwardly of the firebox rear panel 18 a spaced apart distance thereby forming an air passage 58 thereinbetween. The bottom flue panel 56 extends from the firebox front panel 20 rearwardly to the lower edge of the flue rear panel 53. An aperture or opening 59 is formed in the rearward portion of the flue bottom panel 56 and is positioned wholly outwardly of the exterior surface of the building wall 5, whereby outside air may enter the same. The upper portion 51 of the flue is interconnected with the lower flue portion 50 by a trapizoadally intermediate portion 60.

An outer casing member 65 is attached to the fireplace unit and is positioned a spaced apart distance from the flue 3 and firebox 2 to form passageways thereinbetween wherein cool air flows to cool the hot interior walls of the firebox and flue. The outer casing 65 comprises a rear wall 66, a forward wall 67, opposing side walls 68 and 69, and a base plate 70. The base plate 70 includes an inlet opening or aperture 71 therethrough which is disclosed directly underneath the base flue opening 59, and is provided with a protective screen member 72 constructed of means such as wire mesh to prevent foreign objects from entering the fireplace unit. The cavity between the outer casing 65 and the firebox and flue forms air current passageways 73, 74 and 75 therebetween.

A spark arrestor 78 which is particularly adapted for use with mobile homes is attached to the free end of the outer casing 65 and prevents hot, burning ashes which raise through the flue 3 from escaping into the atmosphere and landing on flammable materials such as an adjacent building roof. Because mobile homes are typically arranged in very close proximity, and are generally more flammable than conventionally constructed buildings, the hazard of fire is increased. The illustrated arrestor 78 includes imperforate top and side panels 79 and 80 respectively which are interconnected to form a rectangularly shaped structure having a pair of open sides 81. The open sides 81 are covered by a relatively fine screen material 82, such as wire mesh, which allows the flue gases to escape to the atmosphere, yet retains the large particles of ash.

As best illustrated in FIGS. 1 and 4, the firebox bottom panel 15 is positioned directly above flue opening 59 and base plate aperture 71, and includes a pair of opposing side edges 85 and 86 which abut against the interior surface of the firebox side panels 16 and 17 respectively. The bottom panel 15 includes a rear edge 87 which abuts the interior surface of the firebox rear panel 18, and a forward portion 88 which is bent upwardly into a reversed, flattened Z-shape. The bottom panel side edges 85 and 86 are provided with apertures or openings 89 therethrough which communicate the inlet opening 71 with the interior of the firebox, whereby outside air is supplied to the burning materials therein to support combustion. In the illustrated example, each of the side edges 85 and 86 is provided with the plurality of spaced apart, semi circular apertures 80 which form a scalloped effect and are adapted to uniformly introduce air into the firebox area.

A plurality of transversely extending ribs 92 are attached to and depend from the bottom surface of the firebox bottom panel 15 in a mutually and regularly spaced apart manner. The ribs 92 support the bottom panel 15 above the flue base panel 56 thereby forming an aperture therebetween through which air may flow from the outside atmosphere into the firebox area. The forward portion 88 of the firebox bottom panel is spaced upwardly a predetermined distance from the lower panel 94 of the inner hearth 93, thereby allowing outside air to flow through the inlet opening 71 upwardly beneath the firebox bottom panel 15 and forwardly over the forward edge 94 thereof into the area of combustion to support the same. In the illustrates example, the ribs positioned adjacent the firebox side walls 16 and 17 are provided with a plurality of spaced apart transverse apertures 95 which allow the incoming air to flow toward the sides of the firebox area as illustrated by the arrows 96 in FIG. 5.

The firebox back panel 18 is provided with a pair of baffles 99 formed at the lower sides edges thereof which allows air flowing between the firebox back panel 18 and the flue rear panel 53 to enter the firebox area and support the combustion of the fuel as illustrated by the arrows 100 in FIG. 2. In the illustrated structure, a pair of V-shaped braces 101 (FIG. 4) are fixedly attached to the rearward surface of the back panel 15 and provide additional rigidity thereto and positively separate the same from the flue rear panel 53 by a predetermined distance.

In use, the sliding doors 35 and 36 are opened, and the user sets logs or other combustible materials 104 (FIG. 2) on the grate member 105. The combustible materials are then ignited, and the heat generated thereby forces the flue gases upwardly between the damper 21 and firebox rear wall 18 and through the flue 3 and spark arrestor 78 as illustrated by the arrows 106. The fire in the firebox heats the firebox walls 16, 17 and 18 which in turn heats the air in the air current passageways 73, 74 and 75. The air therein tends to flow generally upwardly where permitted in continuous streams as indicated by the arrows 107 as a result of thermal expansion and is expelled into the atmosphere at the spark arrestor 78. This air movement in both the flue 3 and the cooling passageways 73, 74 and 75 creates a slight vacuum in the unit and draws outside air through the screen 72 and into the unit in a manner referred to as thermal siphoning. A portion of the outside air flows directly into the cooling passageways 73, 74 and 74 flows as indicated by the arrows 107. The remainder of the outside air drawn into the unit through the screen 72, is directed into the firebox through the bottom panel side apertures 89 (arrows 109) and forward passageway 108, (arrows 110) and the back panel baffles 99 (arrows 100) and supports the combustion therein, whereby substantially no air is drawn from inside the room by the flue. The outside air approaches the fuel 104 from the front sides and back of the firebox, thereby providing complete and even combustion. As more fuel is applied to the fire, the thermal siphoning is accordingly increased to supply sufficient air to oxidize the fuel, as well as cool the fireplace unit. If the fire has not completely burned out before the user wishes to leave the area, he may simply slide the doors 35 and 36 closed to prevent sparks from entering the room. Since the air required for combustion is provided from the outside through the inlet passageways 59, closing the doors will not choke the fire and the same will continue to burn in a normal and safe fashion. The doors 35 and 36 may be reopened by the user when he returns, and enjoyment of the fire is completely out, the user can close the damper 21 and the doors 35 and 36 thereby preventing cold air from entering the mobile home through the fireplace unit.

It is to be understood that while I have illustrated and described certain forms of my invention, it is not to be limited to the specific forms or arrangement of parts herein described and shown.

What is claimed and desired to secure by Letters Patent is:

1. A prefabricated fireplace structure adapted for mounting in a building wall and comprising:

(a) a fireplace structure having an internal firebox and upper and lower and spaced side support members adapted for supporting the fireplace structure in a wall with the firebox positioned outside of a building and with the firebox having an entranceway to a room;

(b) a flue situated outside of the building and having an internal passage connected to said firebox and upstanding therefrom for exhausting combustion gases to the outside atmosphere, said firebox and said flue being disposed outside of said room and communicating with the outside atmosphere;

(c) an open bottom portion of said fireplace structure located substantially directly below said firebox and open to and communicating the outside atmosphere with the firebox and flue;

(d) outer walls defining an outer shell generally surrounding the firebox and flue and providing air current passageways therearound, said outer walls directly communicating said open bottom portion with said passageways whereby outside air is drawn directly upward by thermal siphoning from said open bottom portion around said firebox and flue for cooling thereof and substantially eliminating the transfer of heat from the firebox and flue to the building wall before being exhausted back to the outside atmosphere;

(e) said firebox having an interior area with a plurality of draft openings leading thereinto and communicating with said air current passageways for drawing the outside air upwardly through said open bottom portion and into the firebox by said thermal siphoning; and (f) said draft openings being arranged around said firebox and of an area commensurate with the size of the internal passage in the flue for supplying all of the air necessary for combustion and for uniformly distributing the outside air to burning fuel in the firebox, including (1) a firebox base having opposite side portions with a plurality of apertures therethrough and which abut associated side walls of the firebox, said apertures being located directly above the draft openings and communicating the open bottom portion with opposite bottom side areas of the firebox so that the outside air flows through the apertures and over the firebox base for supplying a fire located thereabove;

(2) said firebox base including a forward portion having a forward margin with an airflow opening means therealong communicating the open bottom portion with a lower, forward area of the firebox for flow of outside air thereinto; and (3) a firebox rear panel having opposite side portions with respective openings therein communicating the open bottom portion with a generally lower, rear area of the firebox, whereby the outside air is drawn through said rear panel openings and into the lower, rear area of the firebox and flows over the firebox base to supply a fire located thereabove and whereby, during combustion in said fireplace structure, a portion of the outside air is drawn smoothly and evenly upwardly through said open bottom portion and into said firebox to supply the burning fuel therein with outside air for complete and even combustion thereof without drawing inside air from the room and whereby another portion of the outside air is drawn into the passageways around the firebox and flue to thermally insulate the building wall therefrom.

2. A prefabricated fireplace construction as set forth in claim 1 wherein:

(a) said firebox base includes at least two depending ribs for reinforcing said firebox base; and (b) said ribs each have a transverse aperture therethrough for directing the outside air therethrough to a center portion of said firebox.

3. A fireplace construction as set forth in claim 1 wherein:

(a) said firebox base side edges each include a plurality of regularly spaced apart, semi-circularly shaped apertures which form a scalloped effect and uniformly introduce outside air into the firebox along the lower portion of the side walls.

4. A prefabricated fireplace construction as set forth in claim 1 including:

(a) means selectively closing and sealing the firebox entranceway, whereby said fireplace construction is adapted for installation in a mobile home.

* * * * *